US010661931B2

(12) United States Patent
Scaglione

(10) Patent No.: US 10,661,931 B2
(45) Date of Patent: May 26, 2020

(54) AUTOMATIC SYSTEM FOR ORIENTING BOX FLAPPERS

(71) Applicant: MAS PACK S.P.A, San Marzano Oliveto (IT)

(72) Inventor: Gian Luca Scaglione, San Marzano Oliveto (IT)

(73) Assignee: MAS PACK S.P.A., Oliveto (IT)

( * ) Notice: Subject to any disclaimer, the term of this patent is extended or adjusted under 35 U.S.C. 154(b) by 212 days.

(21) Appl. No.: 15/729,897

(22) Filed: Oct. 11, 2017

(65) Prior Publication Data

US 2018/0362200 A1 Dec. 20, 2018

(30) Foreign Application Priority Data

Jun. 19, 2017 (IT) ..... 102017000067729

(51) Int. Cl.

| | |
|---|---|
| ***B65B 43/39*** | (2006.01) |
| ***B65B 43/26*** | (2006.01) |
| ***B65B 21/02*** | (2006.01) |
| ***B65B 43/28*** | (2006.01) |

(52) U.S. Cl.

CPC ..... *B65B 43/265* (2013.01); *B65B 21/02* (2013.01); *B65B 43/285* (2013.01); *B65B 43/39* (2013.01)

(58) Field of Classification Search

CPC ..... B65B 43/38; B65B 43/39; B65B 43/285; B65B 43/265; B65B 21/02

USPC ..... 53/387.1, 387.2, 387.3

See application file for complete search history.

(56) References Cited

U.S. PATENT DOCUMENTS

| | | | | | |
|---|---|---|---|---|---|
| 2,890,560 | A * | 6/1959 | Nigrelli | B65B 43/39 | 53/382.3 |
| 3,587,207 | A * | 6/1971 | Shuttleworth | B65B 43/39 | 53/381.1 |
| 3,662,516 | A * | 5/1972 | Wiseman | B65B 43/39 | 53/76 |
| 3,861,115 | A * | 1/1975 | Peres | B65B 43/39 | 53/76 |
| 4,124,969 | A * | 11/1978 | Peyton | B65B 43/39 | 414/411 |
| 4,478,023 | A * | 10/1984 | Becker | B65B 43/39 | 53/382.3 |
| 4,543,767 | A * | 10/1985 | Wiseman | B65B 43/39 | 53/382.3 |
| 4,587,792 | A * | 5/1986 | Hartness | B65B 43/39 | 493/183 |

(Continued)

FOREIGN PATENT DOCUMENTS

JP S61244719 A 10/1986

*Primary Examiner* — Chelsea E Stinson
*Assistant Examiner* — Himchan "Aiden" Song
(74) *Attorney, Agent, or Firm* — Kelly & Kelley, LLP

(57) ABSTRACT

An automatic system is described, for orienting longitudinal flappers (FL) and transverse flappers (FT) of boxes (S), comprising: a first station for orienting the longitudinal flappers (FL) of the box (S), equipped with first handling means; a third station for orienting the transverse flappers (FT), equipped with third handling means and with a second longitudinal side abutment guide; a second station for transferring the box (S) from the first station to the third station, equipped with first longitudinal side abutment guides; and a transport plane adapted to move the box (S) from the first station to the third station through the second station.

11 Claims, 11 Drawing Sheets

(56) References Cited

U.S. PATENT DOCUMENTS

| | | | | |
|---|---|---|---|---|
| 6,385,945 | B1 * | 5/2002 | Hahnel | B65B 7/20 53/252 |
| 2014/0305084 | A1 * | 10/2014 | Lanzarini | B65B 19/20 53/484 |
| 2015/0151860 | A1 * | 6/2015 | Sain | B65B 7/20 53/376.4 |

* cited by examiner

AUTOMATIC SYSTEM FOR ORIENTING BOX FLAPPERS

BACKGROUND OF THE INVENTION

1) Field of the Invention

The present invention refers to an automatic system for orienting box flappers, in particular of the type placed upstream of a machine for inserting and packaging products inside a box such as, for example and preferably, a machine for inserting bottles into a box.

2) Background Art

Numerous types of in-line machines and systems are known in the art, which take care of opening the packaging box flappers, usually of a cardboard type, and to keep then suitably oriented to allow filling the box with various products, such as, for example, bottles.

An example of these machines is disclosed in JPS61244719, in which the longitudinal flappers of the box are oriented when opening through a splitting device, fixed with respect to the advancement movement of each box while the transverse flappers are oriented through suitable handling devices.

SUMMARY OF THE INVENTION

Object of the present invention is solving the above prior art problems, by providing an automatic system for orienting box flappers which is more efficient and performing with respect to what is proposed by the prior art.

The above and other objects and advantages of the invention, as will result from the following description, are obtained with a system as claimed in claim 1. Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and part with equivalent functionality) can be made to what is described, without departing from the scope of the invention, as appears from the enclosed claims.

BRIEF DESCRIPTION OF THE DRAWINGS

The present invention will be better described by some preferred embodiments thereof, provided as a non-limiting example, with reference to the enclosed drawings, in which.

DETAILED DESCRIPTION OF PREFERRED EMBODIMENTS

To shorted shorten the description, herein below all those parts, such as, for example, mechanical, electronic, fluid-dynamic components, etc. necessary for the basic operation of the system according to the present invention, which are anyway deemed known to a skilled person in the art, will not be described, in order to describe instead in particular the operating aspects and principles characterizing the system itself.

As stated, the system according to the present invention is aimed for the automatic orientation of box flappers, in particular of the type placed upstream of a machine for inserting and packaging products inside a box such as, for example and preferably, a machine for inserting bottles, of a substantially known type in the art.

Figure 1:
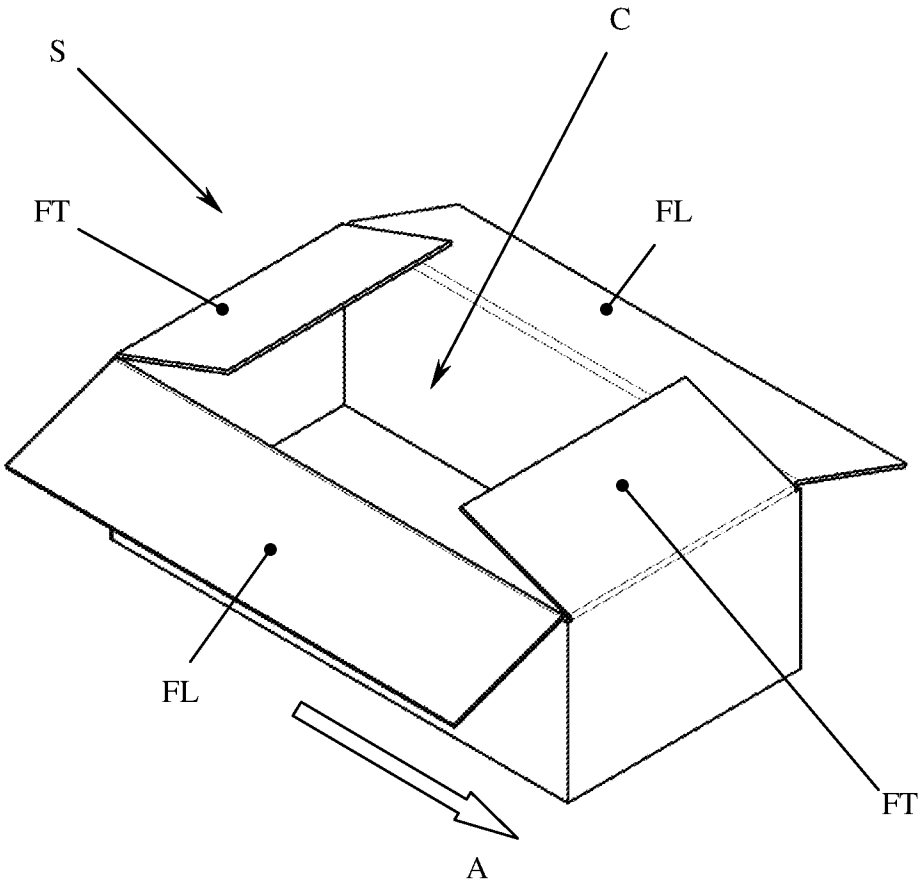
FIG. 1 shows a schematic view of a box used in the system according to the present invention.

In particular, for a better understanding of the operation of the system according to the present invention, as disclosed herein below, reference will ideally be made to a box S like the one schematically shown in FIG. 1, the box S being then composed, with reference to an advancement direction A of the box S along the system according to the present invention, of at least one containing body C having an upper opening delimited on its perimeter by at least one pair of opposed longitudinal flappers FL and at least one pair of opposed transverse flappers FT, the flappers FL, FT being able to rotate along a junction line to the respective side wall of the box S itself: when the flappers FL and FT are overlapped to the upper opening, the box S is obviously in a total closure configuration, while when all flappers FL and FT are arranged in a substantially vertical position and over, namely in a position substantially parallel to the corresponding wall of the containing body C, to which they are constrained through their respective junction line or over, it can be stated that the box S is in a total opening configuration, namely a maximum access is available inside the volume of the containing body C through the suitable upper opening, namely the maximum free area of the upper opening from the overall sizes of the flappers FL and FT. The system according to the present invention then operates to take the flappers FL and FT of at least one box S and, more preferably, of a plurality of boxes S, in the at least substantially vertical position as described above, and to keep the position to allow filling the containing body C, for example through bottles, with a related system or machinery known in the art and here, for obvious reasons of briefness, not shown or described.

Therefore, when, in the following description, the terms "orientation of the flapper(s)" are used, reference will be made to an action of taking the flapper(s) towards the at least substantially vertical position as described above. Similarly, when, in the following description, the terms "oriented flapper(s)" are used, reference will be made to flapper(s) placed in the at least substantially vertical position as described above.

Figure 2:
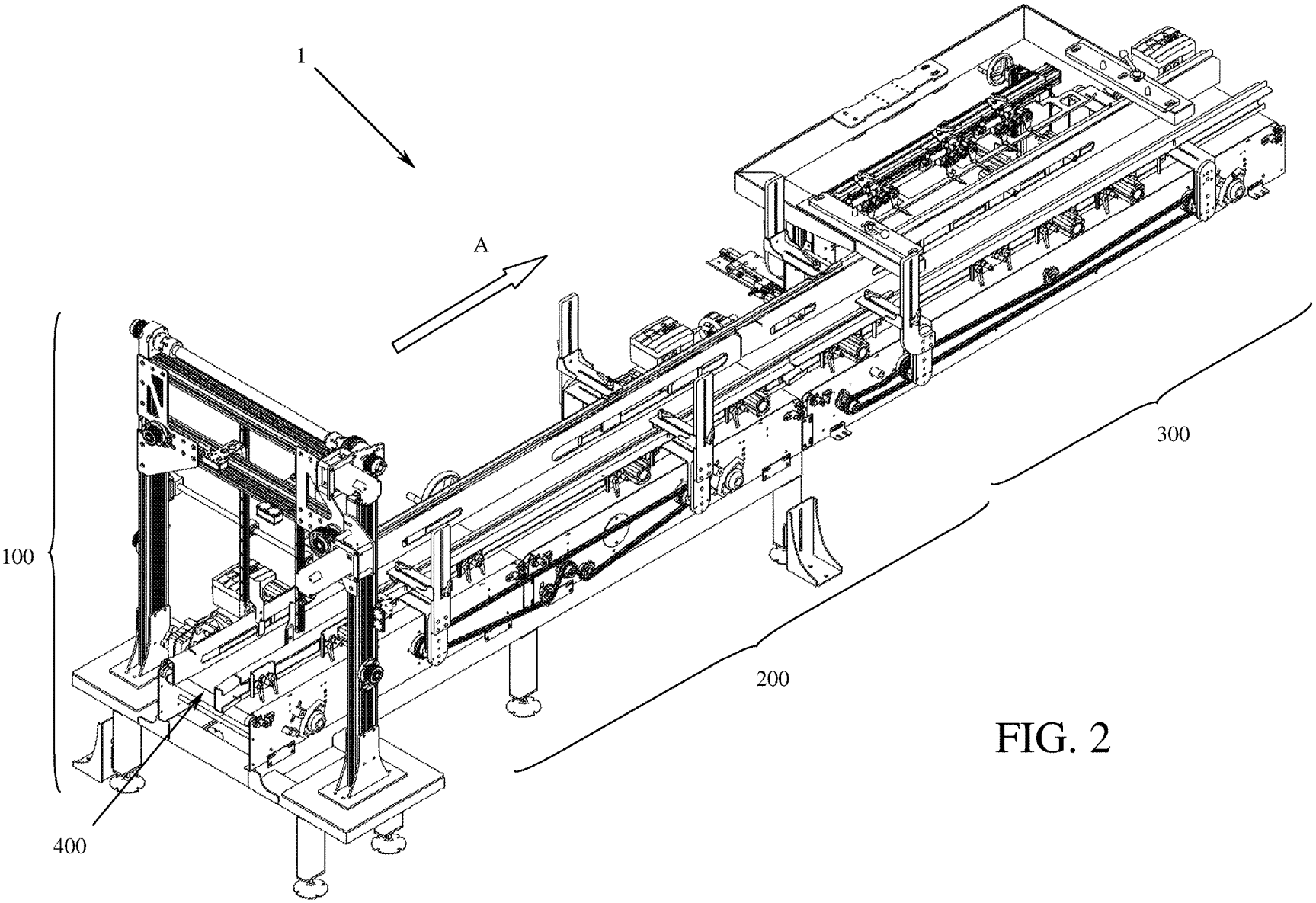
FIG. 2 shows a top perspective view of a preferred embodiment of the system according to the present invention.

With reference then to FIG. 2, it is possible to note that the system 1 for orienting longitudinal flappers FL and transverse flappers FT of boxes S according to the present invention comprises:

at least one first station 100 for orienting the longitudinal flappers FL, the first station 100 being equipped with first handling means 101 adapted to take the longitudinal flappers FL to a raised position with respect to a plane of an upper opening of the containing body C of the box S: for example, depending on the amount of action of the handling means 101, the raised position can get to coincide with the at least substantially vertical position;

at least one third station 300 for orienting the transverse flappers FT of at least one the box, the third station 300 being equipped with third handling means 301E, 301M adapted to take the transverse flappers FT to an at least substantially vertical position, and with at least one second longitudinal side abutment guide 303 adapted to keep the longitudinal flappers FL oriented in at least in an at least substantially vertical position;

at least one second station 200 for transferring the box S from the first station 100 to the third station 300, the second station 200 being equipped with first longitudinal side abutment guides 201 adapted to take or keep the longitudinal flappers FL at least in the at least substantially vertical position during a movement of the box S according to the advancement direction A along the second station 200; and at least one transport plane 400 adapted to move the box S from the first station 100 to the third station 300 through the second station 200 according to the advancement direction A.

Figure 3:
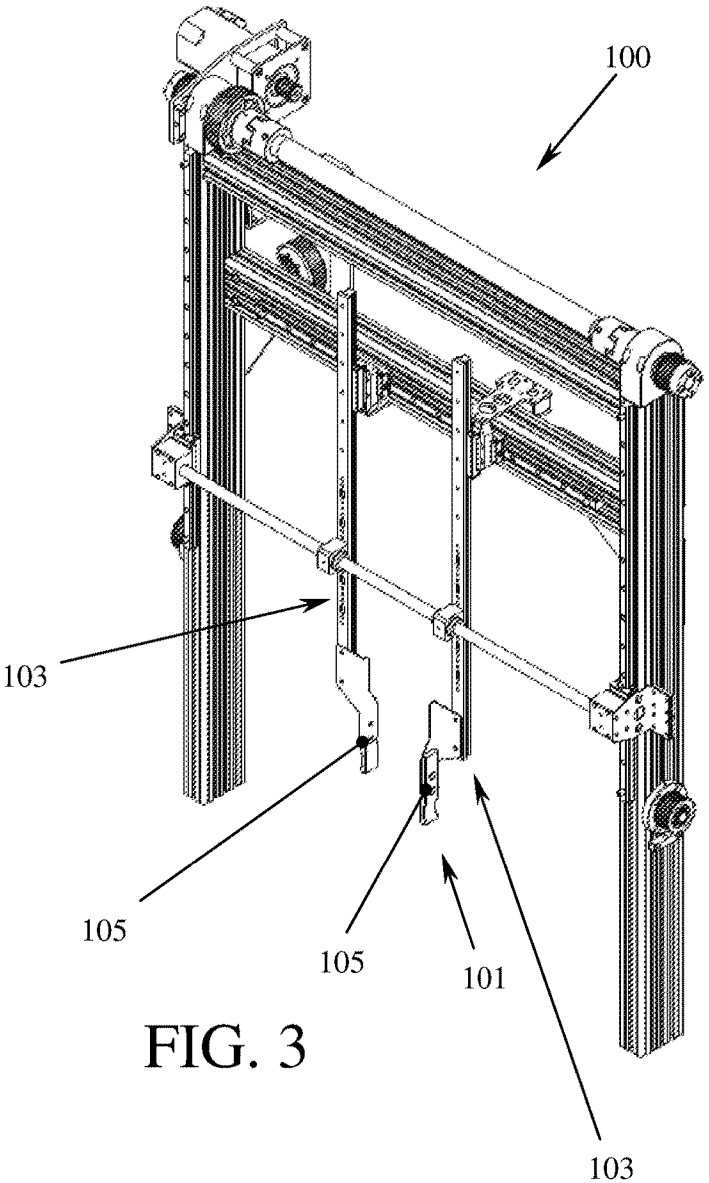
FIG. 3 shows a top perspective view of a preferred embodiment of a first station of the system according to the present invention.

Advantageously, as it is possible to note in particular in FIG. 3, the first handling means 101 of the first station 100 comprise at least one pair of opposed splitting arms 103 arranged above the transport plane of the box S, the pair of opposed splitting arms 103 being adapted to be taken from a first folded-back operating position in which they are inserted between the longitudinal flappers FL to a second operating splitting position in which the longitudinal flappers FL are lifted, at least slightly, with respect to the plane of the upper opening of the containing body C of the box S: like previously, depending on the amount of action of the handling means 101 and, in particular, the amount of the above splitting, the raised position can get to coincide at least with the at least substantially vertical position.

Figure 4B:
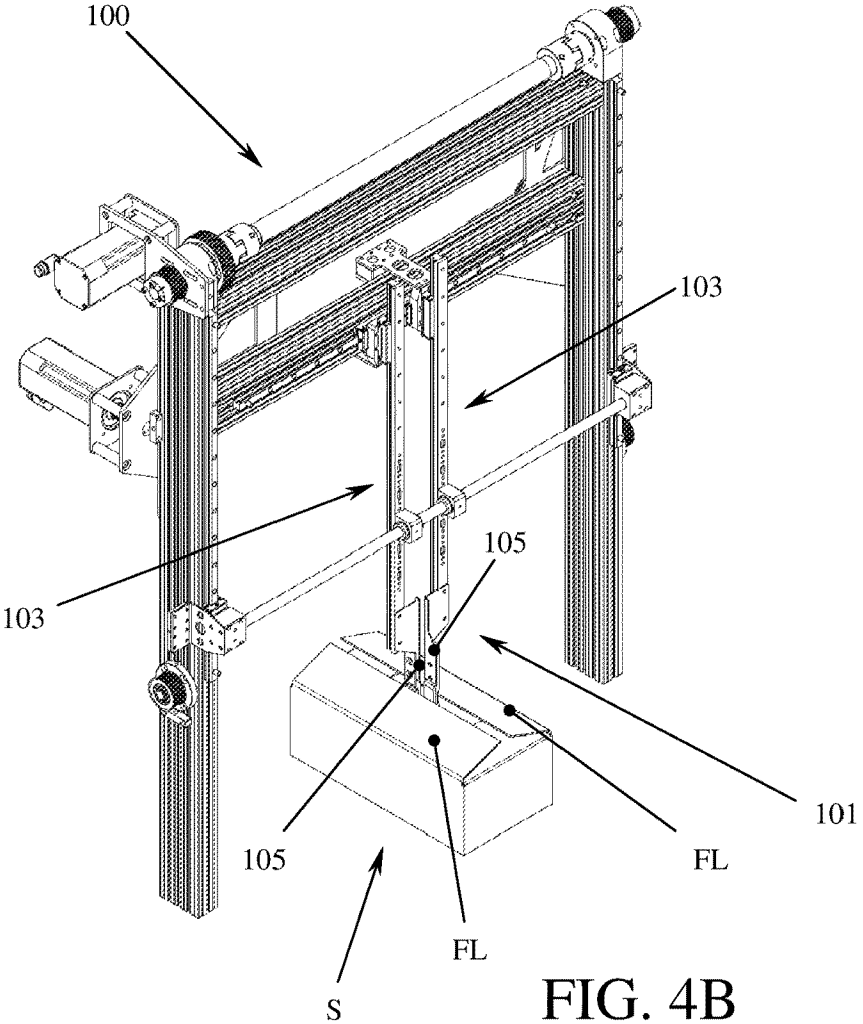
FIGS. 4*a* to 4*e* show some operating steps performed by the first station of FIG. 3.
Figure 4A:
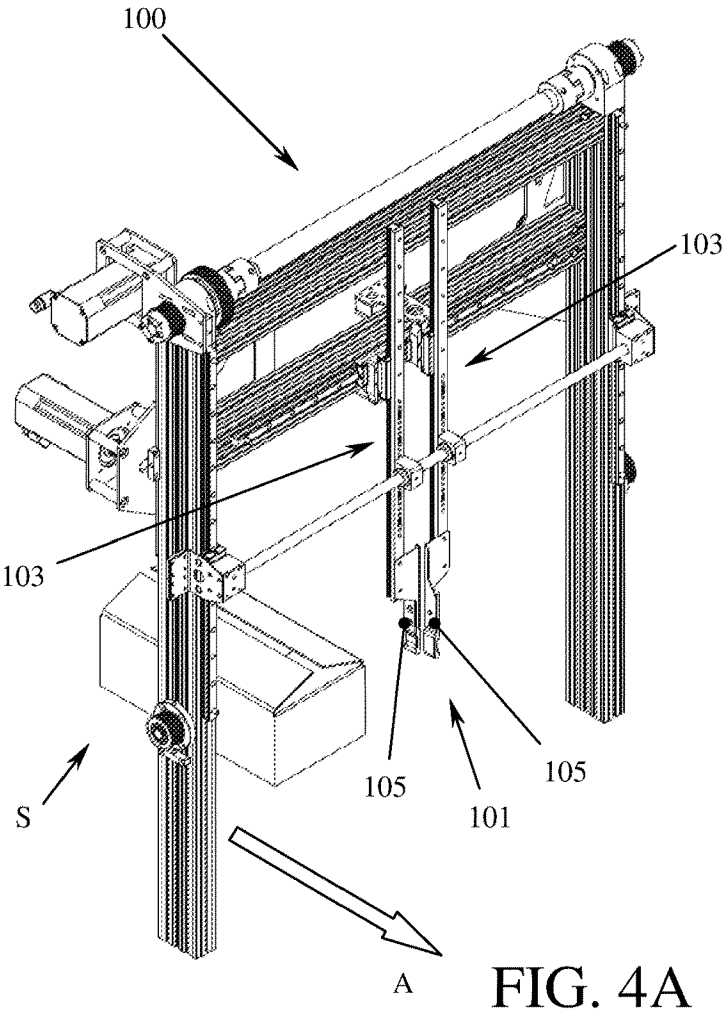
Figure 4D:
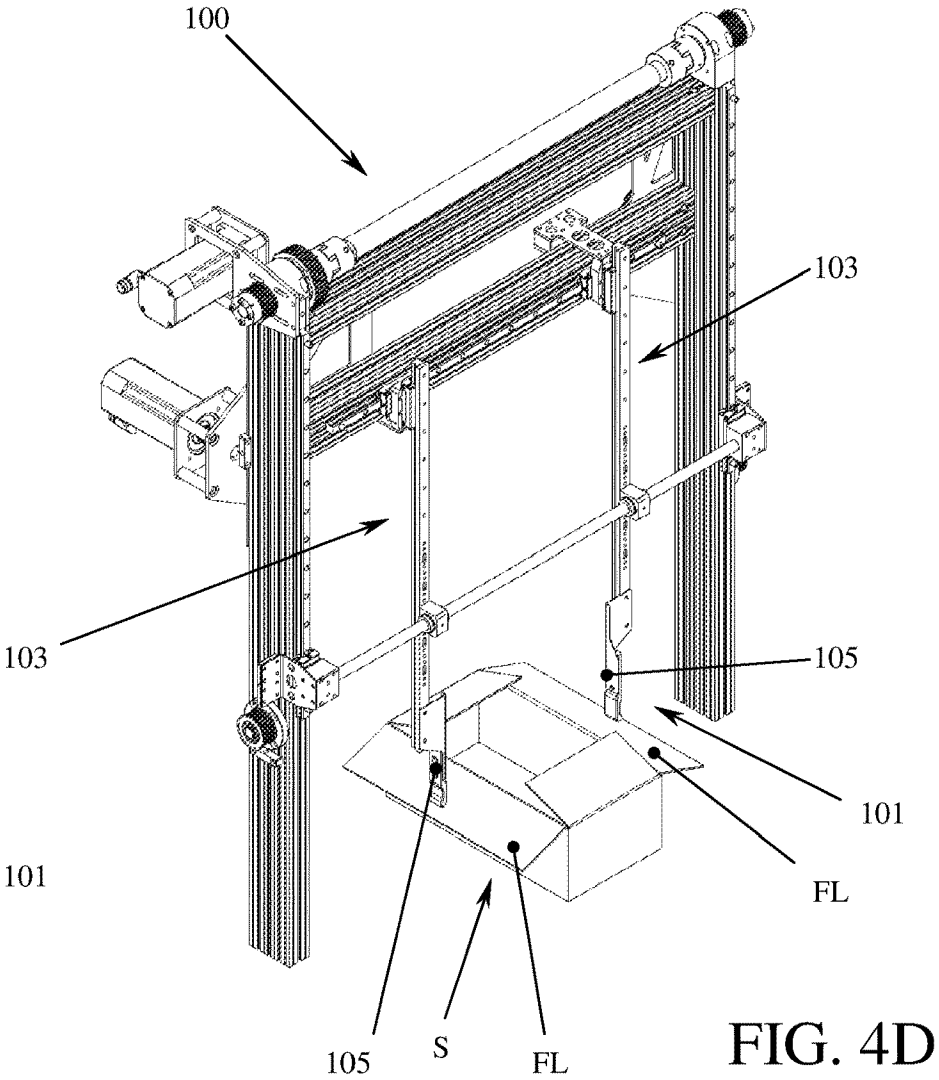
Figure 4C:
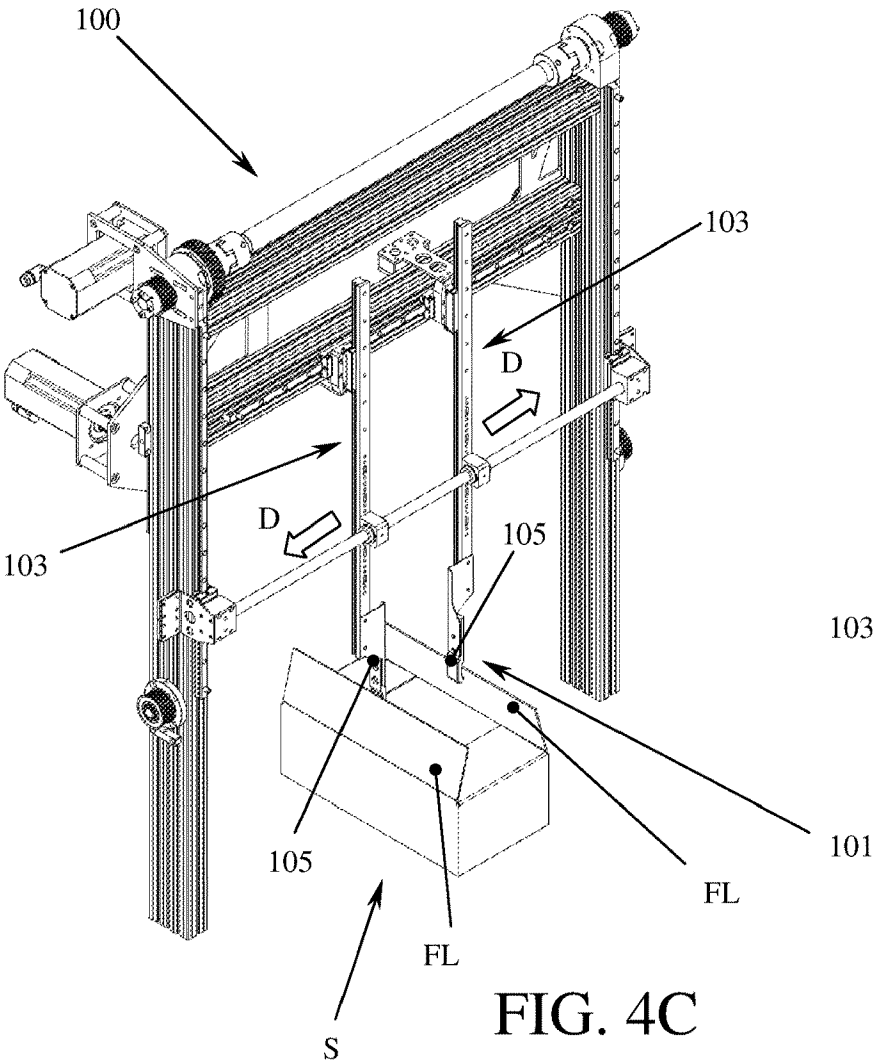

In particular, each of the arms 103 is equipped with a respective handling end 105: advantageously, the pair of opposed splitting arms 103 is therefore adapted to assume the first folded-back operating position (like the one, for example, shown in FIGS. 4*a* and 4*b*) in which the arms 103 are kept suitably nearby one to the other, so that the respective handling ends 105 are near enough to be able to be inserted through the interspace between two longitudinal flappers FL of a box S taken from the transport plane below the first handling means 101. Once having reached this situation, in which the handling ends 105 abut against the respective longitudinal flappers FL of the box S, the opposed splitting arms 103 are taken to go away one from the other along a moving-away direction D orthogonal to the advancement direction A (as shown, for example, in FIG. 4*c*) to reach the second operating splitting position (like the one, for example, shown in FIG. 4*d*) in which the longitudinal flappers FL are taken to an at least slightly lifted position. At that time, the transport plane 400 takes care of transferring the box S to the second station 200, in which the first longitudinal side abutment guides 201 take (in case the longitudinal flappers are only lifted, but not till they reach the at least substantially vertical position) or keep the longitudinal flappers FL in the at least substantially vertical position during a movement of the box S according to the advancement direction A along the second station 200 towards the third station 300. The pair of splitting arms 103 are then taken back to their first operating position to repeat the above described operations for a following box S.

Figure 4E:
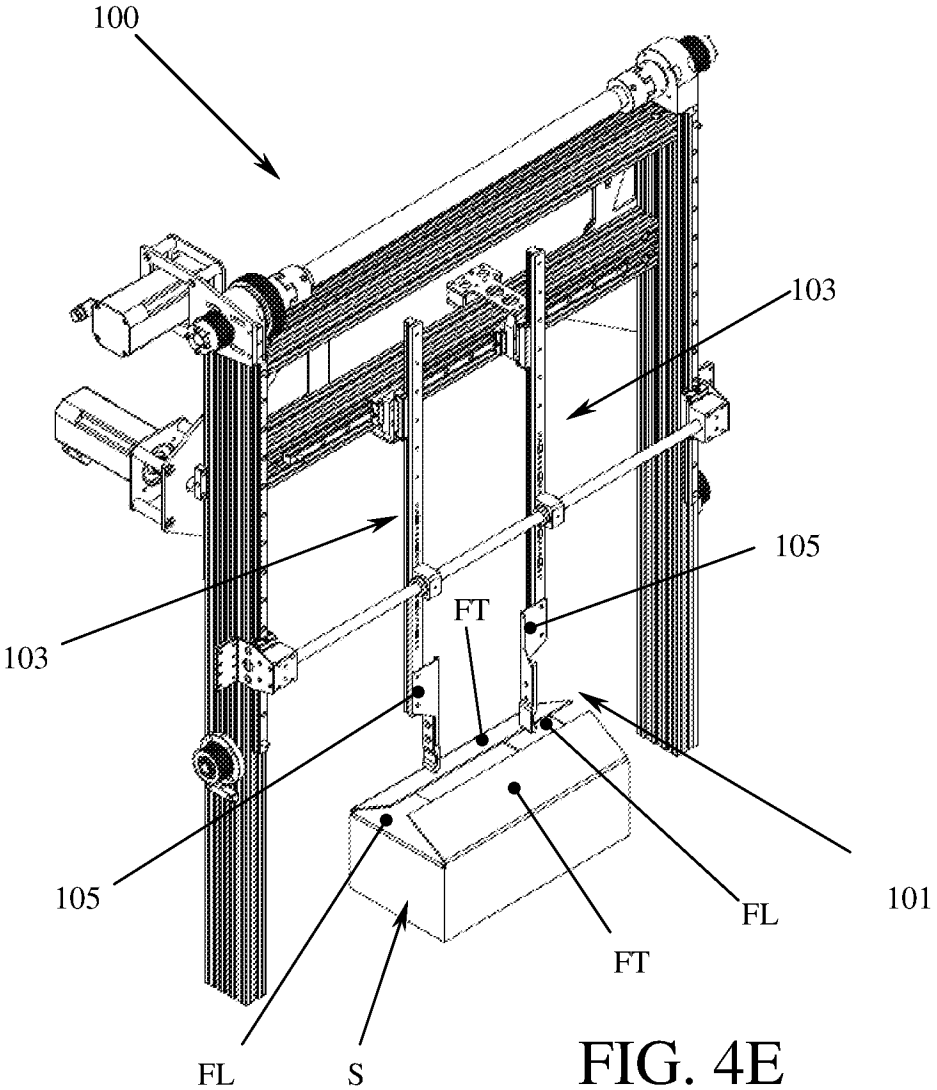

Advantageously, as it is possible to note in particular in FIG. 4*e*, the pair of opposed splitting arms 103, and of their respective handling ends 105, are configured in order to be able to obtain the lifting of the longitudinal flappers FL also in case they are surmounted by the transverse flappers FT, leaving enough access room for the interspace between the longitudinal flappers FL below, namely for example in case the box S is supplied to the first station 100 by the transport plane in a position rotated by 90° around a rotation axis which is vertical with respect to the position of the box S itself, as shown in FIGS. 4*a* to 4*d*.

Figure 5:
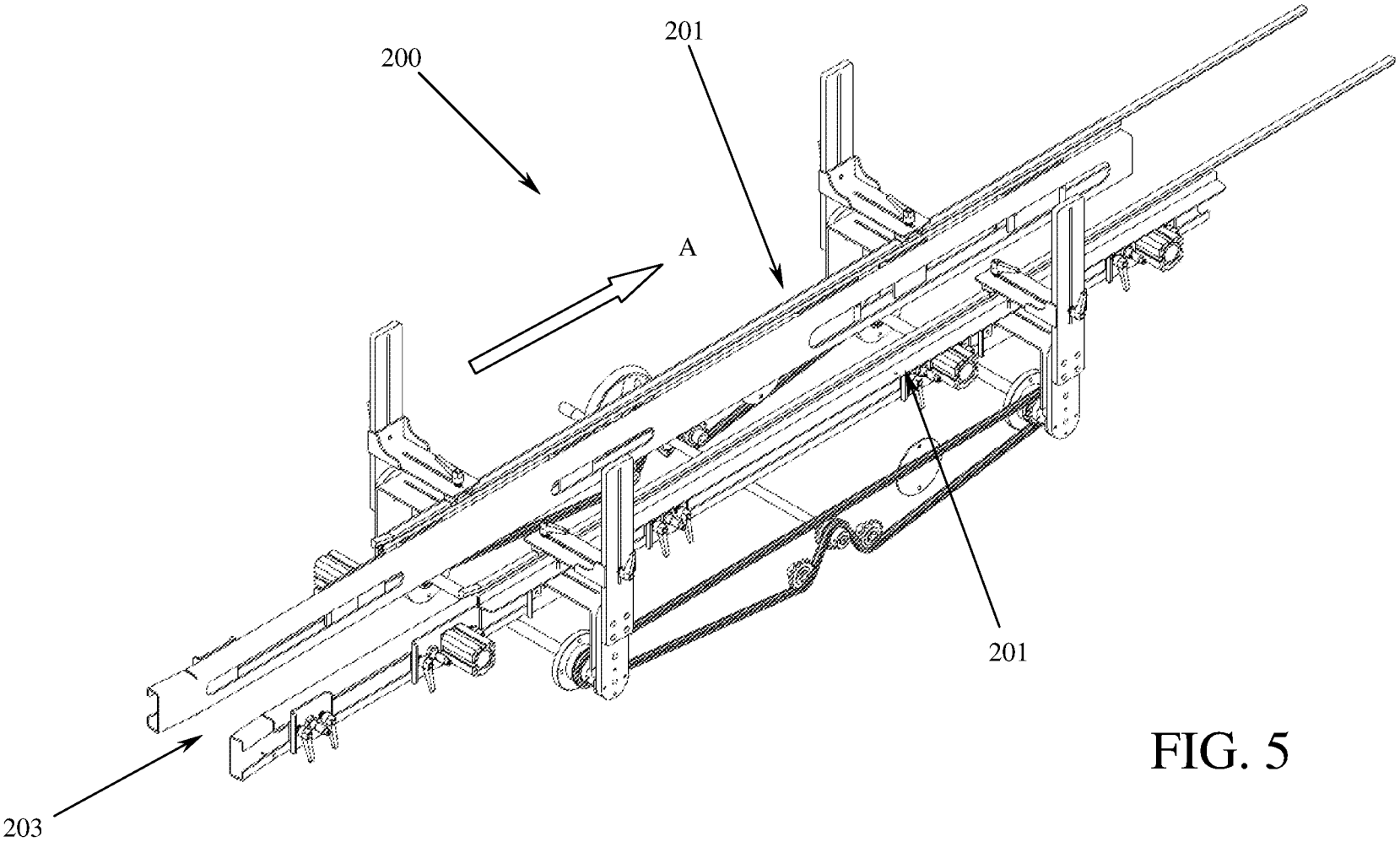
FIG. 5 shows a top perspective view of a preferred embodiment of a second station of the system according to the present invention.

In particular, as it is possible to note in particular in FIG. 5, in the second station 200, the first longitudinal side abutment guides 201 are arranged parallel to the advancement direction A and on the two opposite sides of a transferring corridor 203 served by the transport plane, the first longitudinal side abutment guides 201 being arranged at such a height and along such an orientation with respect to the transport plane as to cooperate with a respective longitudinal flapper FL of a box crossing the second station 200, in order to take it or keep it in at least a substantially vertical position during a movement of the box S according to the advancement direction A along the transferring corridor 203 of the second station 200 towards the third station 300.

Figure 6:
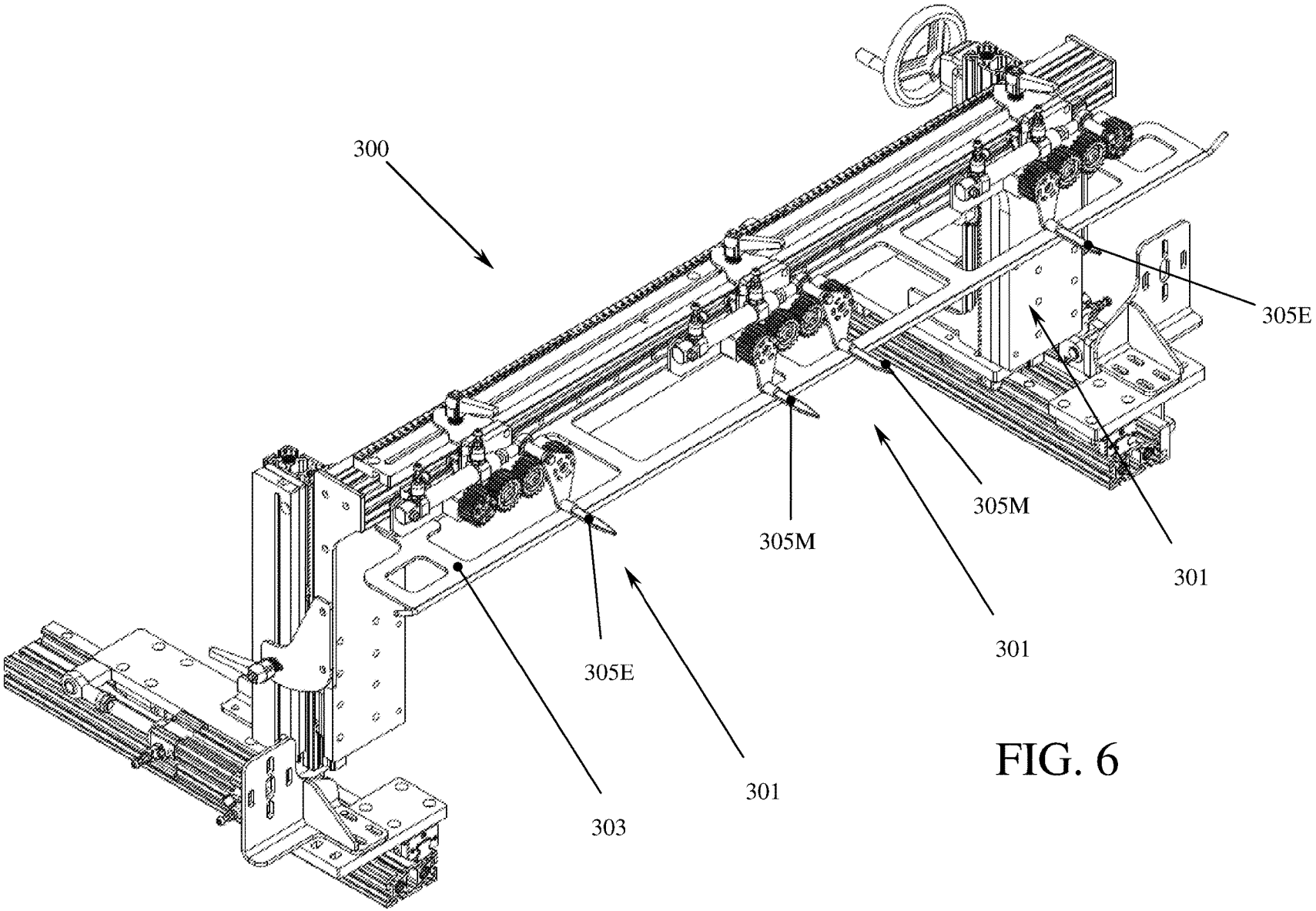
FIG. 6 shows a top perspective view of a preferred embodiment of a third station of the system according to the present invention.

The transport plane 400 takes then care of moving the box S from the second station 200 to the third station 300, like the one for example shown in FIG. 6, stopping it in a position in which the transverse flapper FT of the box S is placed next with at least one respective third handling means 301E, 301M, which will take care of taking at least one related transverse flapper FT in the at least substantially vertical position, while the second longitudinal side abutment guides 303 take care of keeping oriented the longitudinal flappers FL in the at least substantially vertical position. At that time, the box S is in its total opening configuration (like the one, for example, shown in FIG. 7*c*) such as to allow an inserting and packaging machine (not shown) to place products therein.

Figure 7A:
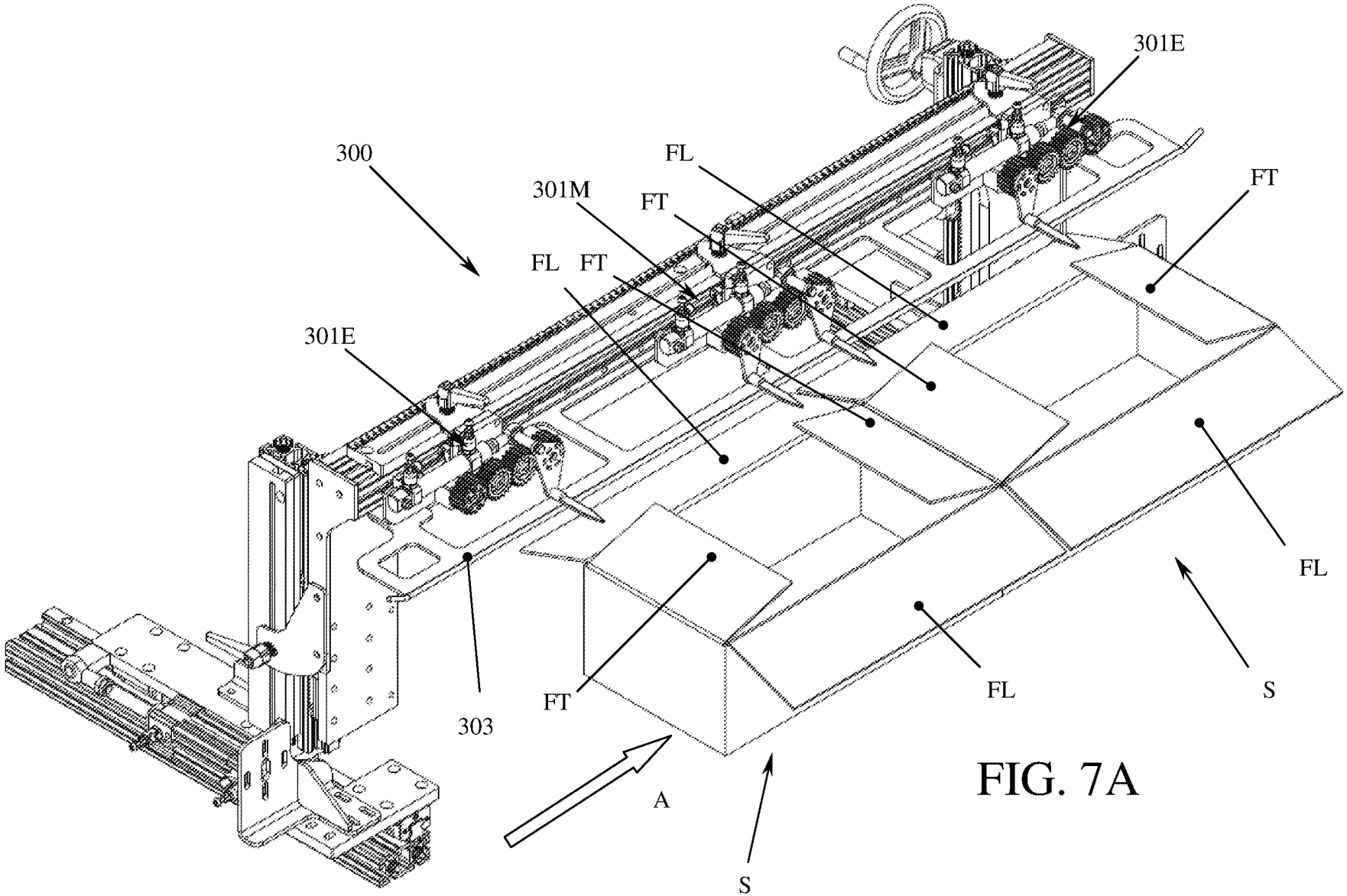
FIGS. 7*a* to 7*c* show some operating steps performed by the third station of FIG. 6.
Figure 7B:
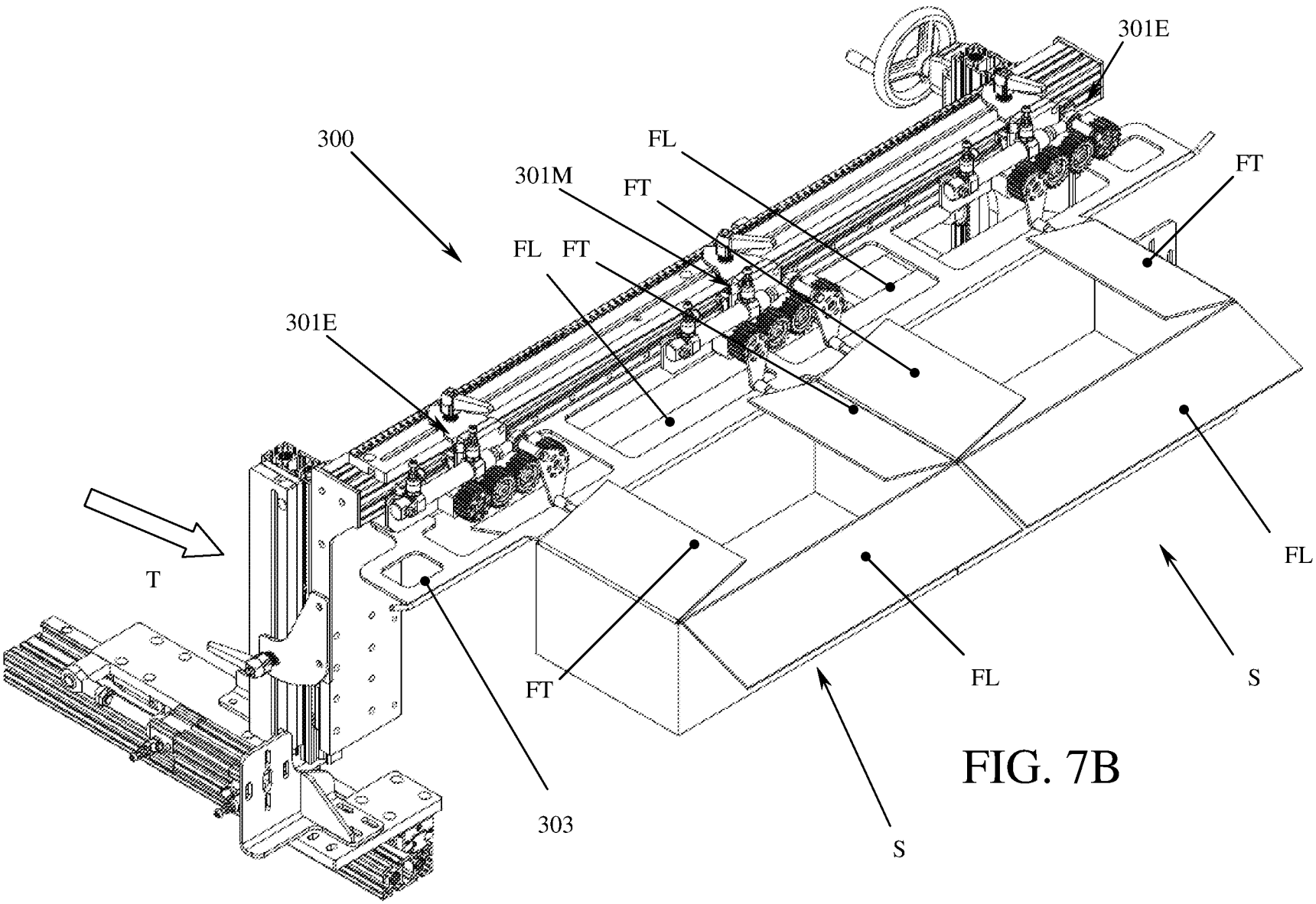
Figure 7C:
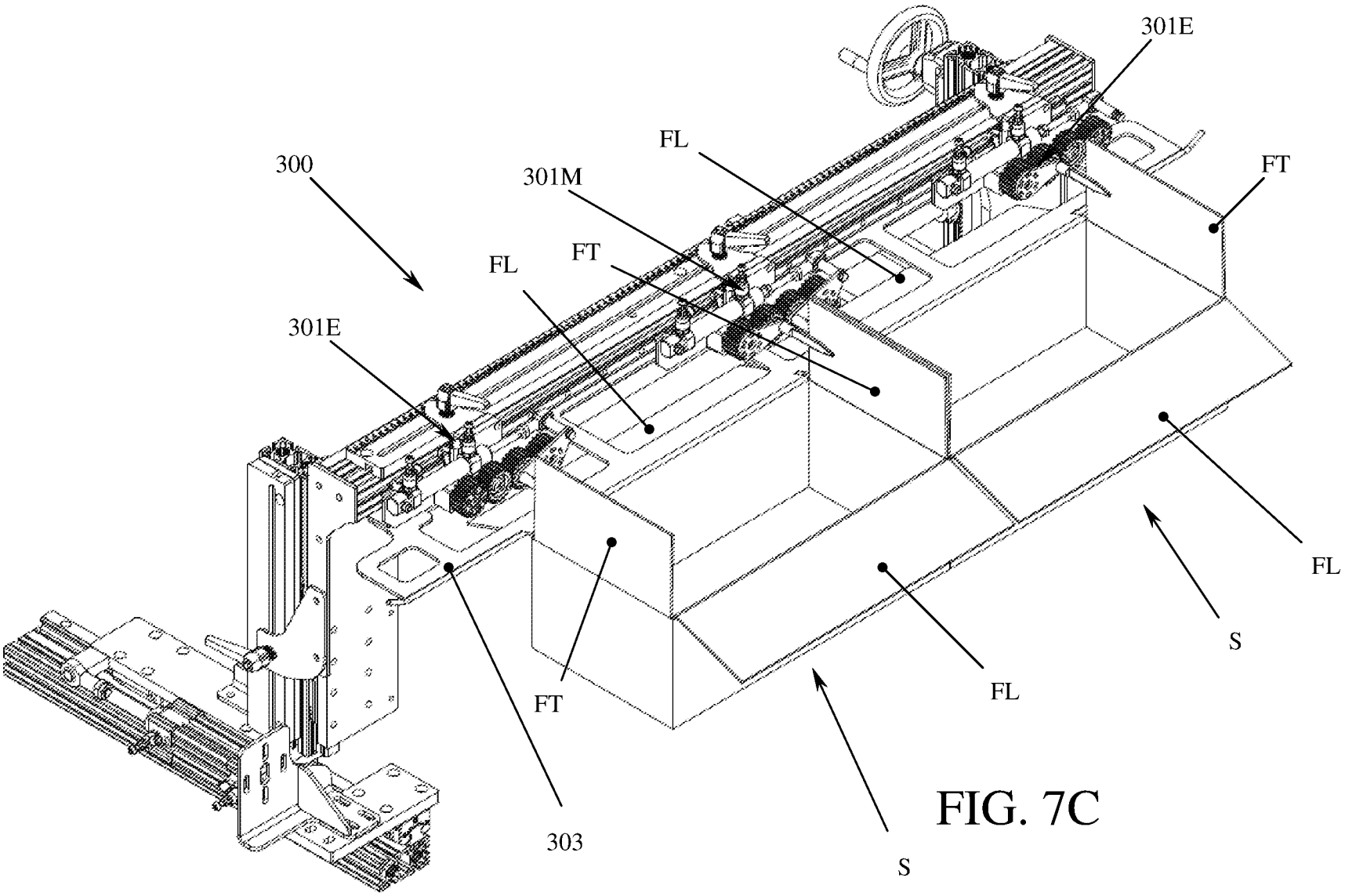

Advantageously, as it is possible to note in FIGS. 6 to 7*c*, the third station 300 can comprise one or more third end handling means 301E, each of which is adapted to handle and orient a single and distinct transverse flapper FT and, possibly, also one or more third intermediate handling means 301M, each of which is adapted to handle and orient a pair of adjacent transverse flappers FT of two contiguous boxes S.

The second longitudinal side abutment guide 303 is arranged parallel to the advancement direction A and vertically below the third handling means 301E, 301M at enough a height from the transport plane to be overlapped from the top to a respective longitudinal flapper FL of a box S placed in the third station 300, to keep it suitably oriented in the at least substantially vertical position.

In particular, the third handling means 301E, 301M comprises a mechanism with mobile fork.

For example, the mechanism with mobile fork of the third end handling means 301E can be composed, having to handle and orient a single and distinct transverse flapper FT, of a single fork 305E rotating around a rotation axis substantially horizontal and orthogonal to the advancement direction A, so that, once the at least one transverse flapper FT is abutting onto the fork 305E, its rotation, such as, for example, shown by the sequence of FIGS. 7*a* to 7*c*, takes the flapper FT to be oriented and kept in the at least substantially vertical position.

Moreover, always as an example, the mechanism with mobile fork of the third intermediate handling means 301M can be composed, having to handle and orient a pair of adjacent transverse flappers FT of two contiguous boxes S, of at least one pair of forks 305M rotating around a rotation axis substantially horizontal and orthogonal to the advancement direction A so that, once the pairs of transverse flappers FT are interposed between the pair of forks 305M, their rotation, as show, for example, in the sequence of FIGS. 7*a* to 7*c*, take both flappers FT to be oriented and kept in the at least substantially vertical position.

Preferably, the third station 300 further comprises transverse moving means (not shown) adapted to move the third handling means 301E, 301M along a direction T orthogonal to the advancement direction A of the box S, in order to take at least one transverse flapper FT to be forked by at least one respective fork 305E, 305M and at least one longitudinal flapper FL to be placed below the second longitudinal side abutment guide 303 (as shown, in particular, in FIG. 7*b*).

I claim:

1. An automatic system for orienting longitudinal flappers and transverse flappers of a box, the automatic system comprising:

at least one first station for orienting the longitudinal flappers of the box, the first station being equipped with first handling means adapted to take the longitudinal flappers in a raised at least substantially vertical position and over in an opening direction with respect to a plane of an upper opening of a containing body of the box;

at least one third station for orienting the transverse flappers of the box, the third station being equipped with third handling means adapted to take the transverse flappers to an at least substantially vertical position and over in the opening direction, the third station being further equipped with at least one second longitudinal side abutment guide adapted to keep oriented the longitudinal flappers in the substantially vertical position and over in the opening direction;

at least one second station for transferring the box from the first station to the third station, the second station being equipped with first longitudinal side abutment guides adapted to keep the longitudinal flappers in the at least substantially vertical position and over in the opening direction during a movement of the box-along an advancement direction along the second station; and at least one transport plane adapted to move the box from the first station to the third station through the second station according to the advancement direction;

wherein the third handling means comprises a third end handling means comprised of a mechanism having a single fork being rotatable about a rotation axis substantially horizontal and orthogonal to the advancement direction to raise a transverse flapper of the box into the at least substantially vertical position and over in the opening direction, and a third intermediate handling means comprised of a mechanism having at least one pair of forks each being rotatable about a rotation axis substantially horizontal and orthogonal to the advancement direction to simultaneously raise and orient and dispose a pair of a transverse flappers of two contiguous boxes in the at least substantially vertical position and over in the opening direction between the pair of forks at once.

2. The system of claim 1, wherein the first handling means comprise at least one pair of opposed splitting arms arranged above the transport plane of the box, the pair of opposed splitting arms being adapted to be taken from a first folded-back operating position in which they are inserted between the longitudinal flappers to a second operating splitting position in which the longitudinal flappers are lifted with respect to the plane of the upper opening of the containing body of the box.

3. The system of claim 2, wherein each of the arms is equipped with a respective handling end.

4. The system of claim 1, wherein the first longitudinal side abutment guides are arranged parallel to the advancement direction and on two opposite sides of a transferring corridor served by the transport plane.

5. The system of claim 4, wherein the first longitudinal side abutment guides are arranged at such a height and along such an orientation with respect to the transport plane as to cooperate with a respective longitudinal flapper of the box crossing the second station in order to take or keep the respective longitudinal flapper in the at least substantially vertical position and over in the opening direction during a movement of the box according to the advancement direction along the transferring corridor of the second station towards the third station.

6. The system of claim 1, wherein each of the forks of the third handling means is adapted to handle and orient a distinct transverse flapper.

7. The system of claim 1, wherein the second longitudinal side abutment guides are arranged parallel to the advancement direction and vertically below the third handling means at such a height from the transport plane to be overlapped from the top to a respective longitudinal flapper of the box to keep it oriented in the at least substantially vertical position and over in the opening direction.

8. An automatic system for orienting longitudinal flappers and transverse flappers of a box, the automatic system comprising:

at least one first station for orienting the longitudinal flappers of the box, the first station being equipped with first handling means adapted to take the longitudinal flappers in a raised at least substantially vertical position and over in an opening direction with respect to a plane of an upper opening of a containing body of the box;

at least one third station for orienting the transverse flappers of the box, the third station being equipped with third handling means adapted to take the transverse flappers to a substantially vertical position and over in the opening direction, the third station being further equipped with at least one second longitudinal side abutment guide adapted to keep oriented the longitudinal flappers in the at least substantially vertical position and over in the opening direction;

at least one second station for transferring the box from the first station to the third station along an advancement direction along the second station; and at least one transport plane adapted to move the box from the first station to the third station through the second station according to the advancement direction;

wherein the second station is equipped with first longitudinal side abutment guides arranged parallel to the advancement direction and on two opposite sides of a transferring corridor served by the transport plane, the first longitudinal side abutment guides being arranged at such a height and along such an orientation with respect to the transport plane as to cooperate with a respective longitudinal flapper of the box crossing the second station in order to take or keep the respective longitudinal flapper in the at least substantially vertical position and over in the opening direction during a movement of the box according to the advancement direction along the transferring corridor of the second station towards the third station;

wherein the third station is equipped with second longitudinal side abutment guides arranged parallel to the advancement direction and vertically below the third handling means at such a height from the transport plane to be overlapped from the top to a respective longitudinal flapper of the box to keep the longitudinal flappers oriented in the at least substantially vertical position and over in the opening direction during movement of the box; and wherein the third handling means comprises a third end handling means comprised of a mechanism having a single fork being rotatable about a rotation axis substantially horizontal and orthogonal to the advancement direction to raise a transverse flapper of the box into an at least vertical position and over in the opening direction, and a third intermediate handling means comprised of a mechanism having at least one pair of forks each being rotatable about a rotation axis substantially horizontal and orthogonal to the advancement direction to simultaneously raise and orient and dispose a pair of a transverse flappers of two contiguous boxes in the at least substantially vertical position and over in the opening direction between the pair of forks at once.

9. The system of claim 8, wherein the first handling means comprise at least one pair of opposed splitting arms arranged above the transport plane of the box, the pair of opposed splitting arms being adapted to be taken from a first folded-back operating position in which they are inserted between the longitudinal flappers to a second operating splitting position in which the longitudinal flappers are lifted with respect to the plane of the upper opening of the containing body of the box.

10. The system of claim 9, wherein each of the arms is equipped with a respective handling end.

11. The system of claim 8, wherein each of the forks of the third handling means is adapted to handle and orient a distinct transverse flapper.

* * * * *